United States Patent [19]

Janssen et al.

[11] 4,295,733

[45] Oct. 20, 1981

[54] AUTOMATIC ERROR COLLATOR CAPACITY CONSTRAINTS USING SPARE BIN STRATEGY

[75] Inventors: Donovan M. Janssen; William S. Seaward, both of Boulder, Colo.

[73] Assignee: International Business Machines Corporation, Armonk, N.Y.

[21] Appl. No.: 101,678

[22] Filed: Dec. 10, 1979

[51] Int. Cl.[3] ..... B65H 31/24; G03G 15/00

[52] U.S. Cl. ..... 355/14 SH; 355/3 SH; 355/14 R; 271/288; 414/52

[58] Field of Search ..... 355/14 SH, 3 SH, 14 R, 355/14 C, 14 CH; 414/52, 43; 271/287, 288, 289, 290, 296, 297

[56] References Cited

U.S. PATENT DOCUMENTS

| | | | |
|---|---|---|---|
| 3,845,949 | 11/1974 | Acquaviva et al. | 271/ |
| 3,915,317 | 10/1975 | White et al. | 414/43 |
| 3,955,811 | 5/1976 | Gibson | 355/3 SH X |
| 4,012,032 | 3/1977 | Rogers | 271/ |
| 4,026,543 | 5/1977 | Ledere | 271/ |
| 4,134,581 | 1/1979 | Johnson et al. | 271/ |
| 4,134,672 | 1/1979 | Burlew et al. | 355/14 |
| 4,163,897 | 8/1979 | Hubbard et al. | 355/14 C UX |
| 4,211,483 | 7/1980 | Hannigan et al. | 355/3 SH X |
| 4,229,100 | 10/1980 | Travis | 355/14 C UX |
| 4,232,861 | 11/1980 | Maul | 271/287 |

FOREIGN PATENT DOCUMENTS

| | | |
|---|---|---|
| 1485476 | 9/1977 | United Kingdom . |
| 2007627 | 5/1979 | United Kingdom . |

OTHER PUBLICATIONS

"Maximizing Collator Reliability", Baumann and Clark-IBM Technical Disclosure Bulletin, vol. 20, No. 4, Sep. 1977.

"Collator-Stapler Module for Copier", Miller-IBM Technical Disclosure Bulletin, vol. 18, No. 10, Mar. 1976.

"Apparatus for Producing Sets of Collated Copies", Research Disclosure, Sep. 1979, #185, pp. 497-499, by R. M. Sterrett.

*Primary Examiner*—R. L. Moses

*Assistant Examiner*—Richard M. Moose

*Attorney, Agent, or Firm*—Joscelyn G. Cockburn

[57] ABSTRACT

Error recovery due to bin overflow in a document reproducing system such as an integrated copier system having a Cycling Automatic Document Feed (CADF), a multibin collator module and a bin unloading mechanism, is effectuated by attaching one or more spare bins or a second collator module and a controller to the reproducing system. Overflow copies from the multibin collator are loaded into the second collator module. A collated set of copies are formed by combining copies from the multibin collator and the second collator module.

12 Claims, 5 Drawing Figures

AUTOMATIC ERROR COLLATOR CAPACITY CONSTRAINTS USING SPARE BIN STRATEGY

BACKGROUND OF THE INVENTION

1. Field of the Invention

The invention relates to the field of sorting/collating devices. Particularly, sorting devices for generating collated sets of copies from a set of original documents.

2. Prior Art

The use of a document reproduction system incorporating a high speed copy processor, a copy collator-unloader module with optional stapler and a document handler module for generating collated sets of copies from an original set is well known in the prior art. A set or pile of original documents to be copied is placed in a document tray. The document handler automatically feeds original documents to be copied in seriatim from the pile onto the document platen of the processor. The processor makes copies from the original document. The original document is then returned to the document tray for removal or for recirculation. The copies outputted from the processor are collated into individual sets by the copy sorter-stapler module. If the copy sorter-unloader module is a multiple bin collator, each set is placed in a bin of the collator. The collated set is removed by an operator or if the sorter includes an automatic unloader and stapler, the sets are removed by the automatic unloader and optionally stapled by the stapler.

A particular problem which is associated with the above type of reproducing system is that of bin overflow. The bin overflow is an error condition which occurs when the number of originals or the number of copies required is greater than the capacity of the bin. Since most of the modern reproducing systems are automatic and high speed, there is a need for an error recovery apparatus and method which is automatic and correct an overflow error condition in a relative short time interval.

Thus U.S. Pat. No. 4,134,672 discloses a method and apparatus for recovering from an overflow condition in a single bin copier finisher system. The copier finisher system consists of a copier for reproducing copies from original documents. An intermediate tray is mounted to the copier. Copies which are generated by the copier are loaded into the tray. A finisher including an automatic unloader and a stapler access the intermediate tray to remove copies therefrom. The copies are stapled together to form a set. The set is then loaded onto an output tray. When the number of originals in a particular job is greater than the capacity of the intermediate tray, the job is divided into at least two runs. In the first run, the number of copies made is equivalent to the capacity of the intermediate tray. The automatic unloader then removes the copies generated in the first run and places them on the output tray. In a similar manner, copies generated from subsequent runs but for the same job are fetched from the intermediate tray and placed on the output tray until a set of copies equivalent to the original set is made.

Another prior art example of a bin overflow problem is addressed by U.S. Pat. No. 4,134,581. The associated problem is that the number of sheets in an original set of documents are greater than the capacity of the bins of a multibin collator connected to a copier. Once the number of copy sets are known, the bins of the collator are configured into so-called virtual bins. Each virtual bin includes at least two actual bins. As such, the virtual bin extends the capacity of an actual bin so that collated sets of copies are formed in the virtual bins. One limitation associated with the virtual bin approach is that the number of copy sets should be at least smaller than the number of bins in the multibin collator and preferably smaller than one half the number of bins.

SUMMARY OF THE INVENTION

It is, therefore, the object of the present invention to correct for a bin overflow condition in a more efficient and effective manner than was heretofore possible.

In general, the present invention includes an electrophotographic copier to which a Cycling Automatic Document Feed (CADF) module and a multibin collator-finisher module is coupled to form a unified document reproducing system. The multibin collator includes an advertised set of bins and an unadvertised set of bins. The unadvertised set of bins may be a separate collator module. The advertised set of bins define the capacity of the collator. The capacity of each bin defines the maximum number of sheets in a collated set. The unadvertised set of bins are spare recovery bins which are used to contain the balance of sheets needed to form one or more complete collated sets when a bin overflow condition occurs. A controller controls the CADF and the multibin collator-finisher modules so that overflow copies from the advertised bins are loaded into the unadvertised or spare bins. Completed collated copy sets are formed by combining copies from the spare bins and the advertised bins.

In one feature of the invention, as spare bins and advertised bins are emptied, the controller uses the additional empty bins to deposit overflow copies. The process has a pyramidal effect which reduces the time needed for the system to recover from an overflow condition.

The foregoing and other features and advantages of the invention will be apparent from the following more particular description of the preferred embodiment of the invention, as illustrated in the accompanying drawings.

DETAILED DESCRIPTION OF THE PREFERRED EMBODIMENT

Figure 1:
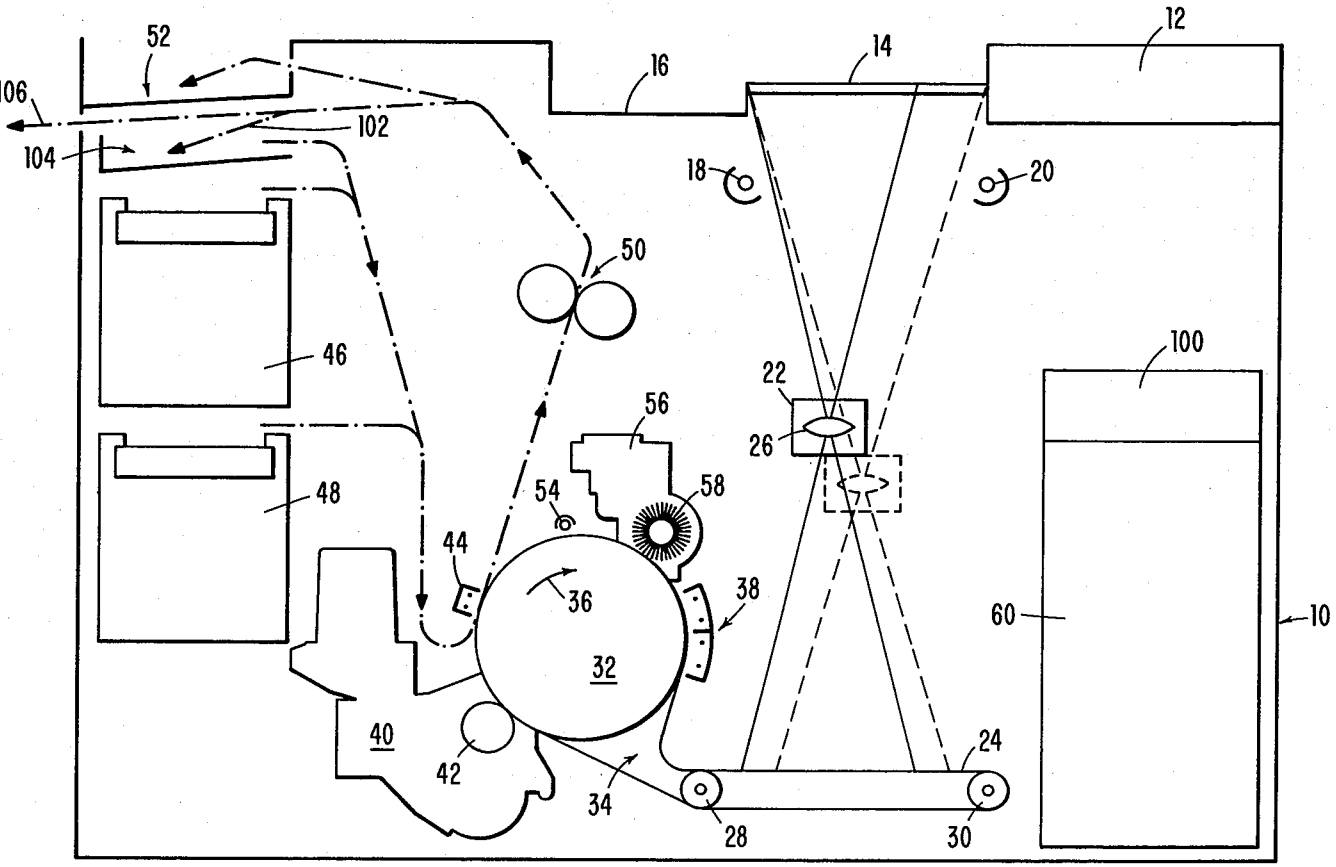
FIG. 1 shows a diagrammatic view of a recirculating automatic document feeder and an electrophotographic copier.

As is used in this application, the phrase "collator-unloader module with optional stapler" means a "finisher." FIG. 1 shows a schematic view of an electrophotographic copier and a recirculating automatic document feeder (RADF). The electrophotographic copier includes a frame 10. The frame is the primary support for the components which coact to form the electrophotographic copier. A recirculating automatic document feed (RADF) also called a cycling automatic document feed (CADF) 12 is positioned and affixed at the top right hand corner of the frame. In operation, a plurality of original documents (not shown) are placed in the RADF and the RADF feeds documents sequentially from a deposited stack onto the document glass 14. After the desired number of copies are made from an original document placed on the document glass, a feed mechanism (not shown) feeds the document from the document glass onto the original document tray 16. From the original document tray, the document is retrieved by an operator. If the machine is running in the recirculating mode, or if an overflow condition exists in the collator bins, the original document is fed back to a stack of documents in the document tray of the CADF where it may be recirculated onto the document glass or removed from the original CADF document tray.

In an alternate embodiment of the invention, the CADF is mounted on the document glass. All documents to be copied are loaded into the document tray of the CADF. The documents are circulated onto the document glass and, after copying, are removed from the document tray of the CADF.

The document glass 14 is fabricated from a transparent material such as glass or clear plastic. Illumination means 18 and 20 are positioned below the document glass. When an original document is positioned on the glass and illumination means 18 and 20 are activated, the document glass and the documents thereon are illuminated. Although a plurality of illumination means may be used, in the preferred embodiment of the invention, the illumination means 18 and 20 are flash lamps having reflectors which focus or distribute the light at the document platen. A focusing assembly 22 is positioned directly below the document glass and in optical alignment thereto. As is used in this application, the term optical alignment means that light emanating from the document glass is focused directly through the focusing assembly 22 onto the photoconductor belt 24. Focusing assembly 22 includes focusing lens 26. In FIG. 1 the focusing lens is shown in two positions. In the topmost position, the electrophotographic machine is operating in the so-called nonreduction mode. In the nonreduction mode, a copy is reproduced on a one-to-one basis. This means that the size of the copy is the same size as the original document. When the focusing lens 26 is positioned in the bottom or lower position, the machine is operating in the so-called reduction mode. In the reduction mode a copy is reproduced at a smaller size than the original document. In the preferred embodiment of the present invention, a wide angle zoom lens with a constant total conjugate length is used as the focusing lens.

It is worthwhile noting that illumination lamps 18 and 20, together with focusing assembly 22, forms the imaging station for the electrophotographic copier. The function of the imaging station is to deposit a latent image of an original document, positioned on document glass 14, onto the photoconductor belt 24. The photoconductor belt 24 is configured into a curved run and a flat run with imaging occurring at the flat run of the photoconductor belt. The flat run of the photoconductor is formed by idler rollers 28 and 30 respectively. The idler rollers are mounted in spaced relationship on frame 10, and as the photoconductor belt is transported passed the imaging station, the idler rollers are freely rotated therewith. The curved run of the belt is formed by a photoconductor drum 32. The drum is journaled for rotation onto the frame 10. The drum is mounted below the document glass but displaced laterally with respect to a perpendicular line drawn from the underside of the document glass towards the bottom of the electrophotographic copier. Likewise, the drum is displaced laterally and vertically from the flat run of the photoconductor belt. A vacuum chamber 34 forms a concave bend in the photoconductor. The concave bend allows a smooth transition between the curved run and the flat run of the photoconductor belt. Of greater importance is the fact that by using the vacuum column instead of a mechanical member to bend the photoconductor belt, there is no physical contact between the bending means and the photoconductor belt. As will be explained subsequently, the vacuum chamber also operates as a means for tensioning the photoconductor belt and prevents the same from slipping as it is transported in its curvilinear and linear orbit.

Still referring to FIG. 1, the drum 32 is cylindrical in shape and is of sufficient diameter so that a plurality of processing stations can be positioned around the periphery. In the preferred embodiment of the present invention, the drum diameter is approximately eleven inches. The drum is rotated in a clockwise direction shown by arrow 36. The drum is driven by a drive mechanism including a motor (not shown). As the drum is rotated, it transports the photoconductor belt to pass within the vicinity of a plurality of processing stations. The first processing station which the photoconductor accesses is the charging station 38. At charging station 38, a conventional charge corona deposits a control charge on the surface of the photoconductor belt. The charge photoconductor belt is transported through the vacuum chamber 34 onto the flat area defined by idler rollers 28 and 30 respectively. The imaging station then deposits a latent image of a document positioned at the document glass 14 onto the photoconductor. The latent image is next transported to the developer station 40. The developer station 40 is positioned about the periphery of the photoconductor drum 32. The developer station is a conventional developer station and will not be described in detail. Suffice it to say at this point, that the developer station includes a fixing material such as toner which adheres to a multiplicity of carrier balls. A magnetic brush 42, having a predetermined electrical bias voltage thereon, allows toner to attach to selective area of the latent image on the photoconductor belt. The carrier balls are deflected by the magnetic brush into the housing of the developer station. Positioned upstream from the developer station 40 and in proximity the photoconductor drum, is the transfer station 44. The transfer station 44 includes a transfer corona. In order to transfer the toned image which now resides on the surface of the photoconductor, a sheet of paper is fed from the duplex tray or paper supply trays 46 or 48 respectively. The sheet of paper moves along the paper path (shown by the arrows) between the transfer corona and the photoconductor drum 32. At this point, the corona deposits a charge onto the paper. The charge on the paper is of opposite polarity to the toned image on the photoconductor. As a result of the electric field between the paper and the photoconducor surface, the toned image is transferred from the photoconductor onto the transfer paper. The paper is then transported into fuser assembly 50. In the fuser assembly, the toner is fused preferably by some heating means, into the paper. The copy sheet is then transferred into exit tray 52. If the copier is fitted with a duplexing feature a duplex button (not shown) is depressed, the copy sheet travels along paper path 102 into the duplex tray 104. From the duplex tray, the sheet travels along the previously described paper path whereby another image is placed on the opposite side of the sheet. If a collator module is attached to the copier and a collator button (not shown) is depressed, the sheet travels along paper path 106 to be collated in the collator and stapler module 110 (FIG. 2A).

Positioned downstream from the transfer station 44 (FIG. 1) is a preclean lamp 54. After the image is transferred from the photoconductor surface, the preclean lamp illuminates the photoconductor. The illumination tends to neutralize the polarity of residual toner on the belt. The neutralized toner is then cleaned by the cleaning station 56 which is positioned downstream from the preclean lamp 54. The cleaning station 56 is fitted with brush 58. The brush scrubs the surface of the photoconductor and removes the residual toner. It should be noted that although the cleaning station and the developer station are shown as separate stations about the periphery of photoconductor drum 32, it is within the skill of the art to combine both stations without departing from the scope or spirit of the present invention. The electronics and power supplies which are necessary to operate the electrophotographic copier, are packaged and mounted in compartment 60. The compartment 60 is operably connected to frame 10 of the electrophotographic copier.

It should be noted at this point, that although the invention is described in association with a belt-type electrophotographic copier, the invention can be used with any type of electrophotographic copier and the association is merely exemplary rather than a limitation on the scope of the invention. A controller 100 is mounted to the frame of the electrophotographic copier machine. The function of the controller is to control the electrophotographic copier, the CADF and the copier finisher module to generate collated or noncollated sets of copies.

Figure 2A:
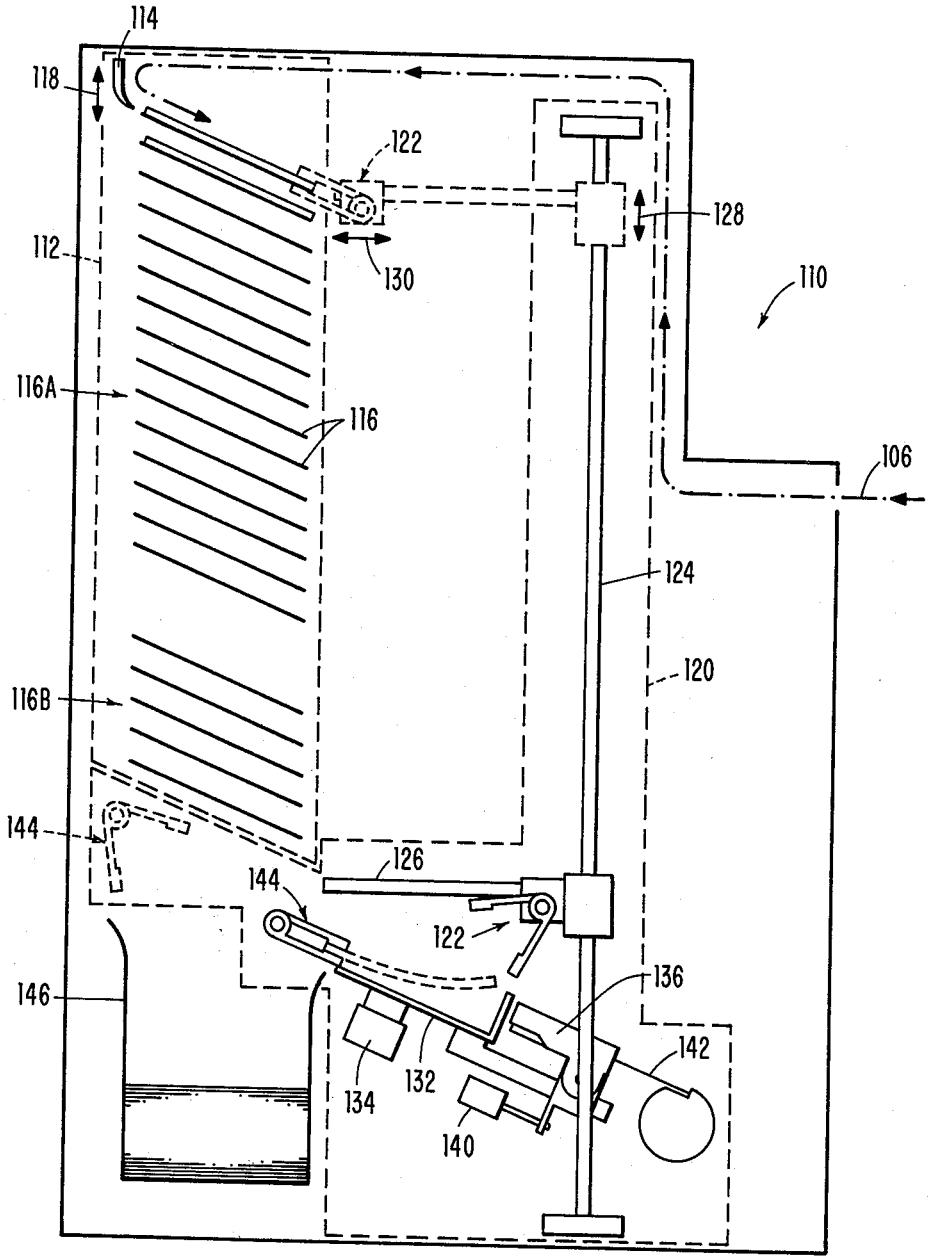
FIG. 2A shows a diagrammatic view of a copy finisher. The copy finisher is suitable for attaching to the electrophotographic copier and recirculating document feeder of FIG. 1 to form an integrated document reproducing system.

Referring now to FIG. 2A, a diagrammatic view of a collator-unloader module with optional stapler, hereinafter called a copy finisher module 110 is shown. The copy finisher module may be a stand-alone unit which can be easily attached to the copier CADF module of FIG. 1. Preferably, the copy finisher module of FIG. 2A is coupled to the left side of the copier/CADF. Alternately, the copy finisher module 110 may be fabricated as an integral part of the copier CADF unit. This means that a common support frame and cover would be used in manufacturing the copy finisher module and the copier CADF module. Whether the copy finisher module 110 is a stand-alone unit or an integral part of the copier CADF module, when the reproduction system is in the collate mode, copy sheets outputted from fuser station 50 are fed along collator path 106 to be collated in the collator module. Either feed rollers (not shown) or vacuum belts (not shown) can be used for transporting the copy sheets along the paper path.

Referring now to FIG. 2A, the copy finisher module 110 includes a collator module 112 and an automatic unloader stapler module 120. The collator module includes a deflector means 114 and a plurality of bins or trays 116. The bins or trays 116 are divided into two sets 116A and 116B respectively. The bins identified by set 116A are the primary or advertised bins. The bins identified by set 116B are the secondary or unadvertised bins. The unadvertised bins are used to house overflow copies from the primary bins. The deflector means 114 may be a movable deflector which travels relative to each bin in a direction shown by double-headed arrow 118 to deflect or collate sheets as they are outputted in seriatim from the copier module along paper path 106. The deflector means 114 may be of the travelling deflector type. The positioning of the deflector means relative to one of the bins is controlled by copier system controller 100 (FIG. 1). As the collating means 114 travels in a vertical path along the left hand edge of bins 116, collated sets of copy sheets are formed into each of the bins of set 116A.

Removal of the collated sets of sheets from each bin and stapling of the sets are done by the automatic unloader-stapler module 120. Stapler module 120 includes an automatic unloader means 122. The automatic unloader means 122 is in the form of a clamp which accesses the bins in collator module 112 and removes collated sets therefrom. The automatic unloader means 122 moves vertically on guide rail 124 and horizontally on guide rail 126 in the direction shown by arrows 128 and 130, respectively. As will be explained in more detail subsequently, if completed collated sets of copy sheets are in the trays, the automatic unloader means will remove each set and place the same on jogger tray 132. However, if a tray has the maximum number of sheets which it can hold and the set is not fully completed, the automatic unloader means will select sheets from at least one bin in set 116A and sheets from at least one bin in set 116B. The sheets are combined on jogger tray 132 to form a complete collated set.

The jogger tray includes a plurality of edge guides and is driven by a motor 134 (FIG. 2A) in a vibratory motion. When a set of sheets are deposited in the jogger tray, the vibratory motion forces the sheets against the edge guides of the jogger tray and align the collated set against a corner reference in the jogger tray. Once the collated set of sheets has been aligned in the jogger tray, the set is ready for stapling. Stapler 136 is positioned relative to the jogger tray. The stapler jaws reach through holes (not shown) in the walls of the jogger tray and staple collated sets of documents together. The motion of stapler 136 is controlled by actuator 140. The action of the actuator is in turn controlled by controller 100 (FIG. 1). Staples 142 are roller fed into one of the jaws of stapler 136. After a collated set is stapled by stapler 136, a movable stacker clamp 144 grips the stapled set, pulls it out of the jogger tray and deposits the same on output bin 146. When the movable clamp is positioned to the extreme left of its travel as is shown in broken lines, it is depositing collated stapled sets onto the output table 146. Similarly when the movable clamp is to the extreme right position of its travel as is shown in solid line, it is extracting collated sets from the jogger tray.

Figure 2B:
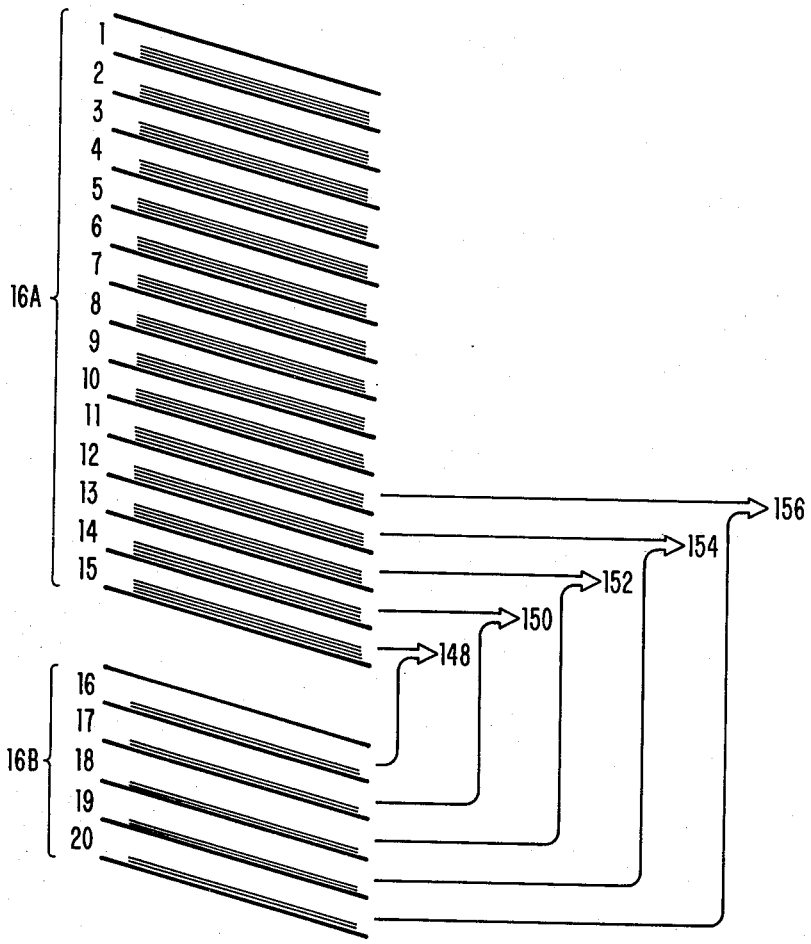
FIG. 2B shows a diagrammatic view of the bins of the collator module. The showing is helpful in understanding the invention.

Referring now to FIG. 2B, a simplified showing of the bins of a multibin collator according to the teaching of the present invention, are shown. The showing is helpful in understanding the present invention. As described above in relationship with FIG. 2A, the deflection means travels along the vertical left edge of the bins to deposit copy sheets in each of the collator bins. Likewise, the automatic unloader travels along the right hand vertical edge of the bins to remove collated sets of sheets from the bins. In FIG. 2B, the bins are numbered sequentially in descending order from bottom to top. However, the number of the bins or the arrangement of the devices which access the bins may be reversed without departing from the scope of the present invention. Also, it should be noted, that the collator may be manufactured with any desired number of bins. The showing in FIG. 2B is only exemplary and should not be regarded as a limitation on the scope of the present invention. Bins 1–15 are the so-called advertised bins. These bins define the capacity of the collator. These bins are the only bins which are available to a user for making copies. Hereinafter these bins are referred to as primary bins. Bins 16–20 are the unadvertised bins. Although these bins are in the collator module, they do not form a part of the regular bins which are available to a user for making collated sets. These bins are hereinafter referred to as auxiliary bins. As was stated previously, the present invention addresses overflow error associated with a collated set of copy sheets. Stated another way, the present invention addresses the situation when bins 1–15 of the collator are filled. That is, the number of sheets in a bin equals the capacity of the bin. However, additional sheets are needed to form a collated set (that is, complete a job). The process necessary to correct for the overflow condition will now be described by way of an example. Assume that the original document to be copied has 60 pages. Fifteen collated sets are required and each of the trays have a capacity of 50 sheets. Since the number of originals exceed the capacity of the bins, it is obvious that collated sets cannot be made. The process steps according to the present invention are as follows:

STEP 1: Primary Bins Collation:

Collate until 15 sets of the first 50 pages of the original document are inserted into bins 1–15 of the collator. It should be noted that the original document with 60 pages is loaded by an operator in the CADF. As will be explained subsequently, the CADF together with the system controller, would keep track of when the first 50 pages of the document are copied and loaded into the first 15 bins of the collator.

STEP 2: Secondary Bins Collation:

Collate 5 sets of pages 51–60 of the original document and load the same into bins 16–20.

STEP 3: Forming Collated Sets:

Control the automatic unloader so that set 148 is made up of sheets 1–50 and sheets 51–60. Sheets 1–50 are taken from one of the primary bins, for example, bin 15. Sheets 51–60 are taken from one of the secondary bins, for example, bin 16. The sheets may be combined in the jaws of the automatic unloader 144 or on the jogger tray to form a complete collated set. In a similar manner, set 150 is taken from bins 14 and 17. Set 152 is taken from bins 13 and 18. Set 154 is taken from bins 12 and 19. Set 156 is taken from bins 11 and 20. It should be noted that the order in which the bins are coupled or addressed to form a complete set is immaterial to the present invention since it is within the skill of the art to form other combinations or to select the bins in other order without departing from the teaching of the present invention. The important point is that whenever the capacity of the advertised or primary trays is exceeded and additional sheets are needed to form a collated set, the excess sheets are loaded into auxiliary or unadvertised bin and a collated set is formed by combining sheets from the primary bin and auxiliary bin, respectively.

Figure 3:
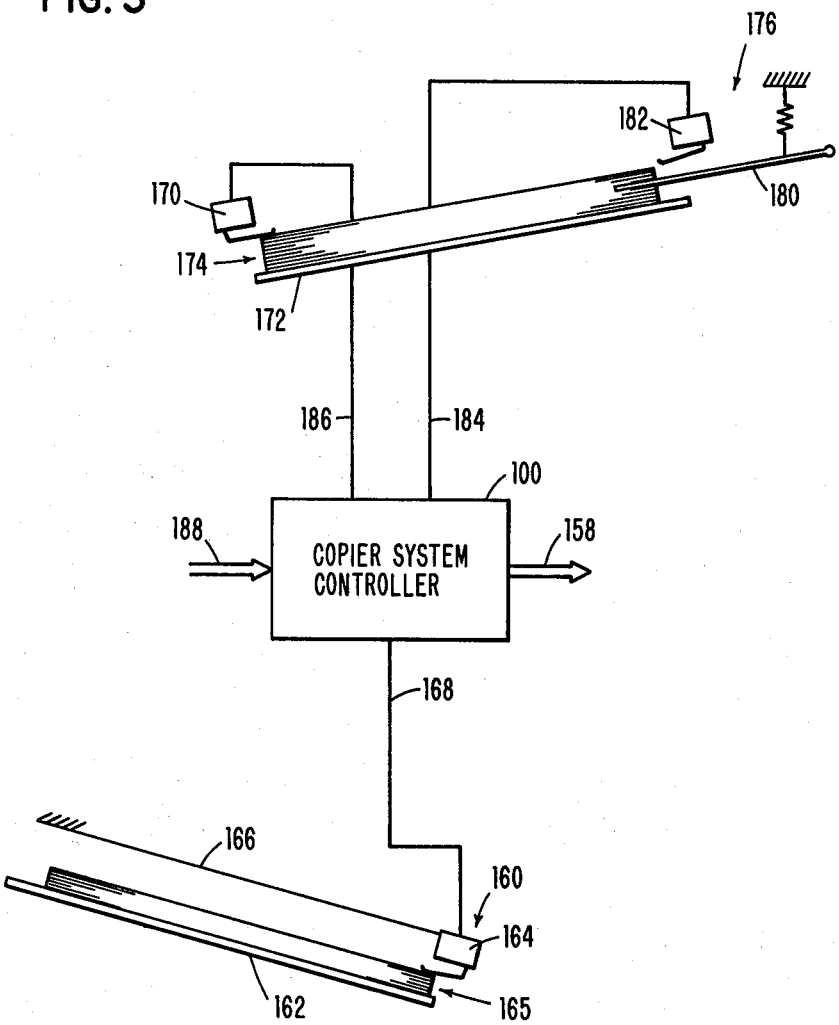
FIG. 3 shows, in block diagram form, a controller for the reproducing system of FIGS. 1 and 2 including the sorter control of the present invention.

One other important aspect of the present invention is the so-called pyramiding of bins. As primary bins are emptied, these bins are added to the number of spare bins available for temporarily supporting overflow copies so that completed collated sets can be made. The pyramidal concept allows a quicker recovery when an overflow condition exists. For example, in the above example, if only one or two bins were designated as auxiliary or spare bins, only two completed collated sets could be made on the first pass. However, on the second pass, four empty bins would be available (two spare bins plus the two unloaded primary bins). On the second pass, four complete sets could be made and the number of complete collated sets which can be made increases with each pass, hence the pyramidal concept. FIG. 3 shows, in block diagram form, the copier system controller 100 and the sensors which sense physical condition in the CADF and the bins of the collator module and generates enabling signal which allows the copier system controller to correct for overflow condition. Although the copier system controller may be done in hard logic in the preferred embodiment of the present invention, a conventional microcomputer is used. Since it is within the skill of the art to select one of the pluralities of conventional microcomputers available on the market, the detail of the microcomputer will not be described. Suffice it to say, enabling signals are generated from the sensors to be described presently. The enabling signals are processed by the microcomputer and control signals are outputted on computer output terminal 158. The signals on terminal 158 control the copier, the CADF and the collator-stapler module.

The collator bin full sensor 160 is mounted in one of the primary bins of the collator module. The function of the collator bin full sensor is to sense when the capacity of a bin in the primary module is reached by copy sheets outputted from the electrophotographic copier. By way of example, each bin in the collator module has a base or bottom 162. A plurality of sheets 165 are fed into the bin by the deflector means. Collator bin full sensor 160 which may include a sensing element 164 attached to the tip of an elongated member or leaf spring 166 is mounted above the stack in spaced alignment with bottom 162 of the bin. The collator bin full sensor 160 is positioned relative to the base or bottom of the bin so that when the last sheet is fed on top of stack 165, the collator bin full sensor 160 is tripped and a collator bin full signal is outputted on conductor 168.

The CADF stack height sensor 170 is mounted in spaced alignment with bottom 172 of the CADF document tray. The CADF stack height sensor 170 is adjustable and is mounted so that it can be adjusted to touch the topmost sheet of a stack 174 positioned within the CADF. The function of the CADF stack height sensor is to give a rough estimate of the number of sheets which are placed in the CADF by an operator. The estimate is determined by converting the distance moved by the CADF stack height sensor 170 from a home position to the last sheet on the stack. The sensor includes a sensing arm attached to a switch so that the state of the switch changes when the sensing arm comes into contact with the stack.

The first page, last page sensor 176 is mounted at the CADF. The function of the last page, first page sensor is to determine the number of sheets which are placed in the CADF and to determine the number of sheets which must be copied in order to form a collated set when a collator bin is full. The last page, first page sensor 176 includes a last page divider 180. The last page divider 180 may be a flat piece of metal which is spring bias mounted so that it works its way through stack 174 as documents are added and removed therefrom. When the last page divider 180 is in contact with last page sensor 182, a signal is outputted on conductor 184. The signal signifies the microcomputer that the CADF has recycled through all the documents in the pile at least once. The signal is used to disable a counter which counts original documents as it is removed from the CADF. In other words, when the signal on conductor 184 is active, the number of documents which were placed in the CADF can be determined with certainty. Stated another way, a signal on conductor 184 signifies that the documents in the CADF document tray has been circulated at least once.

Several prior art sensors may be used to sense the previously described events and output signals to the microcomputer. For example, U.S. Pat. No. 3,565,420 incorporated herein by reference, teaches the use of a movable bale or separator bar which separates the returned original sheets of a set, after copying, from those sheets yet to be copied. At the beginning of copying, this rod is on a first side of the original document set. As copying proceeds, the bar works its way through the set to the other side, thus indicating completion of one recirculation of the original document set. The bar then resets to the first side of the set. U.S. Pat. No. 4,076,408 incorporated herein by reference, is similar in that it teaches the use of a pivoted member or finger which extends into the supply hopper or tray of the CADF for the original document set. This finger operates to separate the sheets into those which have been copied and those which remain to be copied. When this finger reaches the side of a set towards which it incrementally steps one sheet at a time, it swings through an angle greater than 180° arc, it will again sit on the other side of the set thus indicating completion of one recirculation of the original document set.

Figure 4:
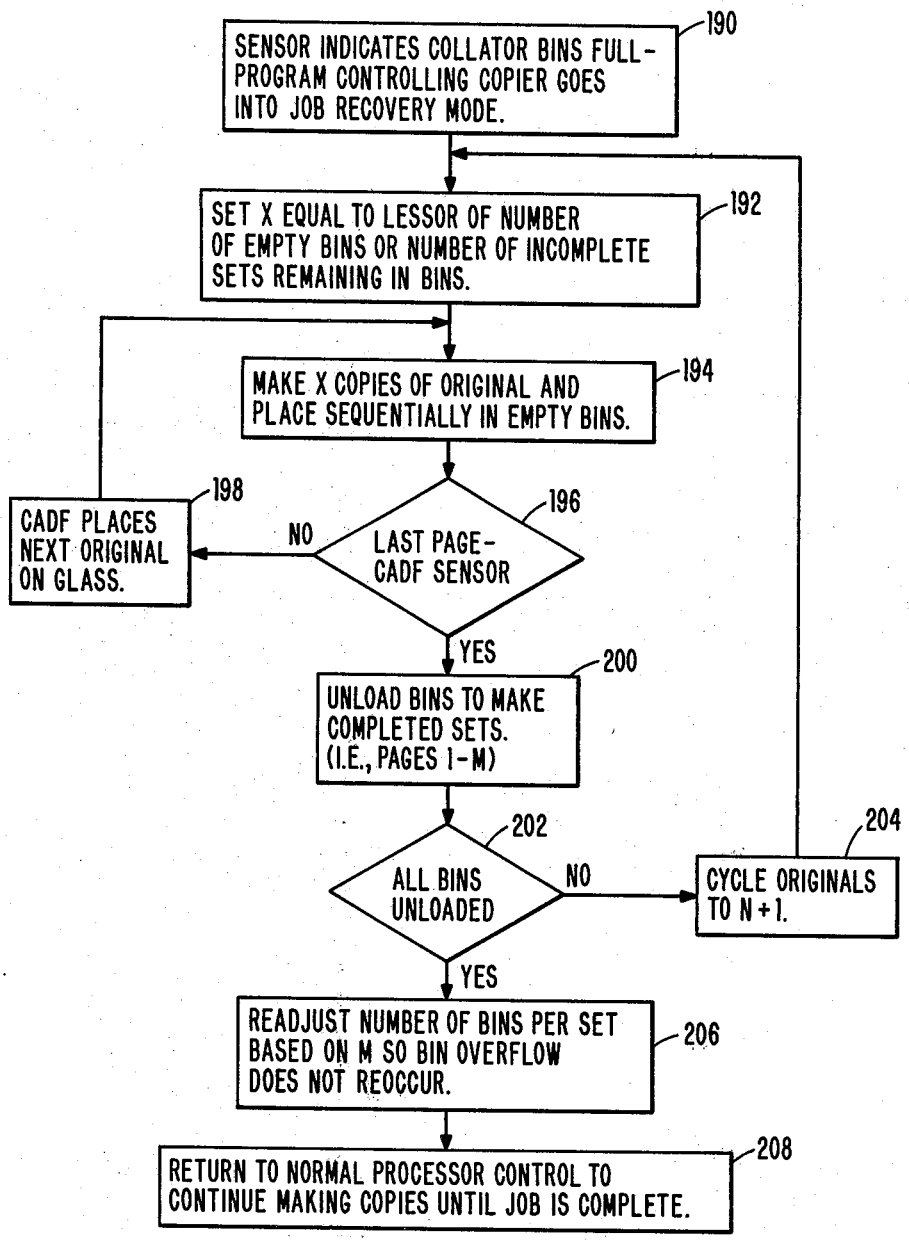
FIG. 4 shows a flowchart of the sequence of operation of the controller of FIG. 3 when the controller is addressing a bin overflow condition according to the teaching of the present invention.

Referring now to FIG. 4 a flowchart of the process steps which are necessary to control the microcomputer so that the overflow condition, according to the teaching of the present invention, is corrected is shown. As was stated previously, the function of the copier system controller 100 (FIG. 3) in addition to controlling the copier system to adjust for a bin overflow condition, also controls the entire operation of the system. To this end, control signal such as signal generated by the CADF stack height sensor 170 (FIG. 3) on conductor 186 is used by the controller to dynamically estimate the number of sheets in a stack of original documents. The controller then dynamically assigns the number of bins in the collator needed to contain a collated set of copy sheets. Likewise, additional control signals are transported on conductor 188 to the copier system controller 100 to utilize and generate other signals which are used to control other copier reproducing functions of the system. Since the other copier function does not form part of the present invention, the function will not be described any further.

Returning now to FIG. 4, each block in the figure represents a process step. Each of the process steps will be described subsequently. However, before addressing the process steps, the following variables will be described:

N—represents the number of original documents copied when the collator bin full sensor 160 indicates that the collator bin is full.

M—represents the number of original documents estimated by the stack height sensor 170. This number may be incorrect. However the exact number in the CADF will be known after the documents are cycled once through the CADF.

X—represents the number of copies of originals to be made when the system is in an overflow error recovery mode.

With the above variables identified, the error condition which initiates the recovery processed according to the present invention is disclosed in box 190. As was stated previously, when a primary collator bin is full, an enabling signal is outputted on conductor 168 from sensor 160. The signal interrupts the normal program which controls the copier system and the microprocessor goes into a job recovery mode and controls the copier accordingly. With the copier and the microprocessor in the job recovery mode, the processor initiates step 192.

The processor sets a number X in one of its working registers. The number X is equal to the lessor of number of empty bins in the collator or the number of incompleted sets remaining in the bins. The processor then progresses to the step 194.

At step 194 the processor controls the system so that X copies of the original document is made. The X numbers of copies are then loaded sequentially into the empty bins. The processor then progresses to step 196.

Step 196 is a decisional step. The processor checks to see if the last page of the document in the CADF has been processed (that is, copied). Whether or not the last page is processed is determined by the signal outputted from last page sensor 176 (FIG. 3). If the last page in the original set of documents has not been reached then the processor goes into a loop and performs step 198 of the program.

Step 198 requires that the CADF places the next original sheet of document on the copy glass. The program then continues in this loop unit the last page of the original set of documents in the CADF is copied. Once this is done, the program exits the loop from process step 196 to process step 200.

At the instant when process step 200 is initiated, at least a few complete sets of collated pages are sitting in primary and auxiliary bins respectively. The microprocessor outputs a signal which controls the automatic unloader to form collated sets by combining copies from primary and auxiliary bins respectively. The processor then progresses to step 202.

Step 202 is again a decisional step. In this step, the program tests to see whether or not all the bins in the collator are unloaded. The testing is achieved by a sensor (not shown) which is positioned at the collator bins and output a signal when the bins are emptied. One type of sensor which may be suitable is an optical type of sensor. The optical sensor includes a light emitting source and a light receiving source. The light emitting source may be a light emitting diode and the receiving source may be a phototransistor. The sensor is arranged so that the light emitting sensor and the light receiving sensor are each positioned at the extremities, that is, the first and the last bin, of the collator module. A hole is bored through the bins so that the light emitting source and the light receiving source are in optical alignment. As such, when there is no paper in any of the bins, the light emitting from the light emitting source is received by the light receiving sensor and a signal is outputted therefrom. However, if paper is in all or one of the bins, then the light is blocked and the light receiving sensor does not emit a signal. Of course, other types of sensors may be used without departing from the scope of the present invention.

In an alternate embodiment of the invention, the controller is used to test whether or not the bins are unloaded. The controller knows how many sets are being made and how many sets are being unloaded. Therefore, by subtracting the number of sets unloaded from the number of sets to be made, the controller determines when the collator is emptied. Still referring to FIG. 4, if after step 202 the bins are not unloaded, then the program progresses to step 204.

In step 204, the microprocessor controls CADF so that the CADF cycles the original document to N+1 sheet. When the N+1 sheet is reached, the sheet is fed to the document platen of the copier to be copied. The program then progresses to step 192 and performs the other step in the manner similar to that previously described.

When the program accesses step 202, if all the bins are unloaded, then the program moves to step 206. As was stated previously, the microcomputer in allocating collator bins suitable to collate a set of copies from a particular set of originals, the number of originals were roughly estimated by CADF stack height sensor 170. This number may be incorrect. If the number was incorrect then the allocation of bins made by the microcomputer would be in error. However, after all the bins of the collator are emptied, as is described in step 202, then the microcomputer has an exact count of the number of originals. Knowing the exact count, the microprocessor at step 206, allocates the number of bins which are necessary to make copies without having an overflow condition. All bins may now be used to maximize number of sets made per CADF cycle. With this completed, the microcomputer progresses from step 206 to step 208. In step 208, the microcomputer returns from the job recovery mode to its normal mode of operation.

OPERATION

In operation, an operator walks up to the copier reproduction system and places a pile of original documents into the CADF. The stack height sensor is adjusted and output signal which indicates a rough estimate of the number of sheets in the pile. The signal is used by the copier system controller 100 (FIGS. 3 and 1) to allocate the number of bins (one or more) necessary to form a collated set of copies of the original. With this estimate, the controller controls the copier system to begin making copies and filling the same sequentially in the advertised or primary bins of the collator. As soon as one or all of the advertised bins reach its capacity, a signal is outputted from collator bin full sensor 160 on conductor 168 (FIG. 3). This signal forces the controller into a job recovery mode.

Simultaneously with making copies of the original document and filling the primary bins, a counter counts the number of original documents which are removed from the CADF. Simultaneously, the first page last page divider of the CADF is working its way through the original pile of documents from one side to the next. As such, at the point when the collator bin full signal is generated on conductor 168, the exact count of the number of documents which has been copied in the CADF is known. At this point, the collator controller also knows the number of unadvertised or auxiliary bins which are available for accepting overflow copies. Assume that the number of unadvertised bins is R and the number of originals which have already been copied is N. The controller will control the CADF so that the (N+1) sheet of the original pile is placed on the copy platen of the copier. Also, R copies of the (N+1) sheet will be made and filled into the R bins sequentially. This process will continue until the last sheet of the original document in the pile is copied and loaded sequentially into the R unadvertised bins. Of course, the last sheet is determined from the signal outputted from the last page first page sensor. With this signal active, the automatic unloader removes sets of sheets from the R bins and the advertised bins in some predetermined order, loading them onto the jogger, which aligns the sheets into collated sets. The sets are optionally stapled by the stapler and removed and placed on the copier output tray FIG. 2.

Assuming that two complete sets were made, this assumes that R equals to two spare bins. The second time around, four spare bins are now available and the processor would cycle the number of originals beginning at the first sheet through (N+1) sheet. The (N+1) sheet is placed on the document platen wherein (R+2) copies of the (N+1) sheet to the last sheet would be made and loaded into the bins. The automatic unloader removes the sheets from the bins in a manner similar to that previously described. The process would be continued until all the bins in the collator are emptied. With the bins emptied, the microcomputer now knows the exact number of original sheets in the original document and assign the collator bins so that collated sets of copies can be contained in the bins.

Although the present invention has been described and explained with respect with a particular embodiment and in the context of a copier reproduction system, an automatic unloader and a CADF, it should be understood that there are changes, modifications and implications other than those specifically mentioned herein which can be carried out by those skilled in the art without departing from the spirit and scope of the present invention.

What is claimed is:

1. In a copying system having a cycling automatic document feed and an automatic unloading apparatus, a device to recover from an overflow collator condition comprising in combination:

a sorter means for containing a plurality of copy sheets of an original document, said sorter means having an advertised set of bins and a number of spare bins for containing overflow copies from the advertised bins;

a loading means associated with the sorter means and operable to load an optimum number of copies into the advertised bins and overflow copies into the spare bins; and an unloading means including an automatic unloading apparatus for forming a complete collated set of copies by merging copies from the advertised bins and the spare bins.

2. The copying system of claim 1 further including a controller means for monitoring the loading means and the unloading means.

3. In a copying system having a circulating automatic document feed and an automatic unloader apparatus, a device to recover from an overflow collator condition comprising in combination:

a collator having a first set of bins for containing a predetermined number of copy sheets;

a second set of bins for containing overflow copy sheets from the first set of bins; and an unloading means for selectively merging copy sheets from the first and second sets of bins to form collated sets.

4. The copy system of claim 3 further including a loading means for selectively loading copy sheets into the first set of bins and the second set of bins respectively.

5. The copy system of claim 4 further including a controller means for controlling the loading and the unloading means.

6. A reproducing system for generating collated sets of copies from an original set of documents comprising in combination:

a copier means for generating one or more copies from an original document;

a document feeder means for feeding documents in seriatim onto the copier means and thereafter feeding the copied document into a document supply tray for removal or for recirculating;

a multibin collator coupled to said copier, said multibin collator having a first set of bins for containing a predetermined number of copy sheets and a second set of bins for containing overflow copy sheets from the first set of bins;

a loader means associated with the collator and operable to receive copy sheets from the copier means and distributing said sheets selectively between the first set of bins and the second set of bins;

an unloader for accessing the first and second set of bins and generating collated sets of copies; and a controller operable for controlling the reproducing system.

7. The reproducing system of claim 6 further including an enabling means operable to generate an enabling signal when one of the bins in the first set of bins is full.

8. The reproducing system of claim 7 further including a sensing means operable to output a signal signifying circulation of a set of original documents placed in the document feeder.

9. A method for controlling the operation of a sheet collator when the capacity M of each primary bin is less than the number of sheets N to be collated in one set, said method comprising of the following steps:

(1) providing a set of primary bins for supporting a predetermined number of copy sheets;

(2) providing a set of auxiliary bins for containing overflow copy sheets;

(3) loading each primary bin to its capacity with M copy sheets;

(4) loading the auxiliary bins with the (N-M) copy sheets; and (5) forming collated copy sets by combining sheets from the primary and secondary bins.

10. A method for controlling the operation of a sheet collator when the capacity M of each primary bin is less than the number of sheets N to be collated in one set, said method comprising of the following steps:

(1) providing a set of auxiliary bins for containing overflow copy sheets;

(2) loading each primary bin to its capacity with M copy sheets;

(3) loading the auxiliary bins with the (N-M) copy sheets;

(4) forming collated copy sets by combining sheets from the primary and secondary bins;

(5) increasing the initial set of auxiliary bins by adding newly emptied primary bins; and (6) loading the newly emptied primary bins with (N-M) copy sheets.

11. A sheet distribution device suitable for use with an electrophotographic copier comprising:

a collator module, said collator module having a first set of bins with each bin having a predetermined capacity to contain a number of sheets;

a second set of bins for supporting overflow sheets from the first set of bins;

a loading means associated with the collator module and operable to load sheets selectively into the first set of bins and the second set of bins; and an unloading means operable to access the first set of bins and the second set of bins and to form collated sets of sheets therefrom.

12. The device of claim 11 further including means for determining when the collator bins are emptied.

* * * * *